114-242 SR
1/21/86 OR 4,565,148

United States Patent [19]
Verhoosel

[11] Patent Number: 4,565,148
[45] Date of Patent: Jan. 21, 1986

[54] SHUNTER AND METHOD FOR DIRECTING THE LONGITUDINAL AXIS OF A SHIP

[76] Inventor: Rudi W. Verhoosel, K1. Jonkvrouwstr 42, 4515 EK., Yzendyke, Netherlands

[21] Appl. No.: 445,077

[22] Filed: Nov. 29, 1982

[30] Foreign Application Priority Data

Dec. 13, 1981 [NL] Netherlands ..... 8105603

[51] Int. Cl.[4] ..... B63B 21/56
[52] U.S. Cl. ..... 114/242; 114/248
[58] Field of Search ..... 114/248, 249, 250, 151, 114/242

[56] References Cited

U.S. PATENT DOCUMENTS

| | | | |
|---|---|---|---|
| 3,322,091 | 5/1967 | Stanwick | 114/242 |
| 3,974,794 | 8/1976 | Kakitani et al. | 114/242 |
| 4,030,441 | 6/1977 | Nagata et al. | 114/242 |
| 4,169,423 | 10/1979 | Laskey | 114/248 |
| 4,175,511 | 11/1979 | Krautkremer | 114/151 |
| 4,275,678 | 6/1981 | Bludworth | 114/248 |

FOREIGN PATENT DOCUMENTS

| | | | |
|---|---|---|---|
| 2518906 | 11/1975 | Fed. Rep. of Germany | 114/248 |
| 745955 | 5/1933 | France . | |
| 1580863 | 9/1969 | France . | |
| 1348652 | 3/1974 | United Kingdom . | |

*Primary Examiner*—Galen L. Barefoot
*Assistant Examiner*—Edwin L. Swinehart
*Attorney, Agent, or Firm*—Lackenbach Siegel Marzullo Presta & Aronson

[57] ABSTRACT

Shunter with which forces can be exerted on the bow and/or the stern of a ship in a direction perpendicular to the longitudinal direction of the ship, so that the longitudinal axis of the ship can be brought into a desired position, such as is especially desirable when entering or passing through a relatively narrow passage, which shunter has a stern of substantially U-form, on the inner-side of the U-form at least one suction head is present which can attach itself to the ship to be maneuvered.

6 Claims, 10 Drawing Figures

SHUNTER AND METHOD FOR DIRECTING THE LONGITUDINAL AXIS OF A SHIP

FIELD OF THE INVENTION

The invention relates to a shunter and a method for directionally maneuvering a ship, whereby the direction of the longitudinal axis of the ship can be set into a certain position, such as is especially desirable when entering and passing through a relatively narrow passage, by exerting on the bow and or the stern of the ship forces in a direction perpendicular to the longitudinal axis of the ship.

It is well known with such a method which amongst others is used when maneuvering ships in locks, to bring the ship in a desired position with the use of a number of tugboats. It is customary to use thereby two tugboats pulling on the bow of the ship and two tugboats on the stern of the ship. The tugboats occupy thereby positions diagonally in front of the ship and diagonally behind the ship, so that in any desired direction forces can be exerted on the ship and the line of movement thereof can be completely controlled.

In entering relatively narrow passages, such as locks, the problem presents itself that it is not possible any longer to exert lateral forces on the bow of the ship, because the pulling tugboats must travel close to the longitudinal axis of the ship in view of the available space. With ships of considerable length, which float highly on the water this can lead to undesirable consequences namely that already with moderate windspeeds the ship is easily brought out of its course. Especially with ships having on the bowside a sharply tapering keel, broadening in the direction of the deck so that an overhanging part is formed, which is especially the case with so called fast carriers, collisions can result with installations on the embankment. Such installations are for instance vertical lift-bridges which are often present near locks and form an important connection in through-ways. It will be obvious that in such situations great direct and indirect damages can arise.

It is an object of the present invention to mitigate these advantages and to achieve other advantages as will be explained here in after, by using a so-called shunter.

BACKGROUND AND SUMMARY OF THE INVENTION

The invention relates to such a shunter with which forces can be exerted on the bow and or the stern of a ship in a direction perpendicular to the longitudinal direction of the ship, so that the longitudinal axis of the ship can be brought into a desired position such as is especially desirable when entering or passing though a relatively narrow passage, which shunter has a stern of substantially U-form, and is characterized in that on the innerside of the U-form at least one suction head is present which can attache itself to the ship to be manoeuvered.

Shunters with a U-like bow are known for instance from the U.S. Pat. No. 4,169,423 and the French Pat. No. 745.955. In these patents the use of suction head is not described. The coupling between the shunter and the ship takes place by means of cables and fenders.

The use of suction heads on tugboats is for instance known from the British Pat. No. 1.348.652 and the French Pat. No. 1.580.863. The suction heads according to these patents however are not present in a U-like part of the tugboat but on the deck thereof. They attach to the sides of the hull of the ship; the tugboat therefore has a position alongside the ship to be drawn. For narrow passages this is, as has been set out above, this is totally not acceptable.

The use of a suction head in a U-form prow or bow of a shunter according to the invention is very advantageous with respect to the well known devices because the coupling between the shunter and the ship takes place exactly there where also the directional forces of the shunter are exerted. Moreover cables are superfluous thereby making the coupling action less labor-intensive and moreover expensive cables can be saved. Furthermore a perfect adaptation can be achieved to the form of the hull of the ship to be directed, ship and shunter forming practically one unit.

A shunter according to the invention preferably also has means such as hydraulically operating adjustment cylinders, to adjust the position of the suction head so that a perfect adaptation to the form of the prow of the ship to be directed can be achieved.

It is furthermore very advantageous to use in a shunter according to the invention a so-called schottel-propulsion, which preferably is rotatable.

Also in off-shore operations such as the unloading of the freight of a sea-going ship into barges for inland transportation with the use of a pontoon crane the problem exists that the position of the sea-going ship, the pontoon crane and the barges with respect to each other must be fixed as far as possible. Especially when there is a certain swell this is hard to be realised in practice. To solve this problem so-called swell compensators have been proposed; these however are expensive and complicated and they do not work in the end really satisfactorily.

Also for these purposes the use of a shunter according to the invention brings about a considerable improvement and simplification.

According to a preferred embodiment of a shunter made according to the invention the shunter has a vacuum source and at least one suction head with suction elements closed by a elastic sealing rim and the latter are in connection with the vacuum source.

According to a further preferred embodiment a shunter according to the invention has a suction head which is subdivided into a number of sections with vacuum elements whereby the position of each section is separately adjustable.

With a shunter according to the invention it is possible to exert very large forces so that a good connection is achievable under all circumstances.

With the embodiment where the suction head is subdivided in separately adjustable and displaceable sections it is possible to couple to arbitrarely curved surfaces.

BRIEF DESCRIPTION OF THE DRAWING

The invention will now be described in more detail with reference to the drawings werein.

DESCRIPTION OF THE PREFERRED EMBODIMENTS

Figure 1:
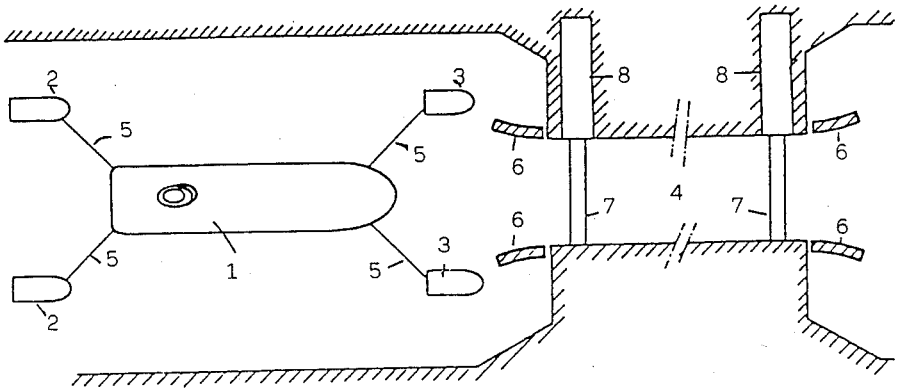
FIG. 1 shows schematically a plan view of a lock with a ship, which is to be maneuvered into the lock with a well known method.

FIG. 1 shows a situation wherein a sea-going ship is maneuvered with the use of a number of tugboats into a lock. The ship 1 is connected with hawsers 5 to two tugboats 2 at the stern. Two tugboats 3 at the front are also connected to the ship 1 with hawsers 5. From FIG. 1 it is clear that with the situation as presented it is possible to maneuver the ship 1 with an acceptable precision in the desired direction, because the tugboats 2 at the stern and the tugboats 3 at the front are sufficiently spaced alongside the longitudinal axis of the ship 1; these boats can therefore exert forces both in a direction perpendicular to the ship 1 and in a direction in the same sense. This situation is changed however when the two tugboats 3 approach the dolphins 6 in front of the lock. The space between the dolphins 6 is relatively narrow so that the front tugboats 3 must of necessity move closer together, which results in a decrease of the lateral forces they can exert on the ship 1.

For clearness sake FIG. 1 also shows the lockdoors 7 which can be rolled away into the space 8. The reference no. 4 indicates generally the lock.

Figure 2A:
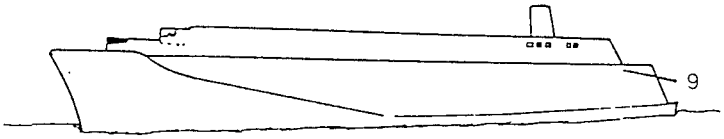
FIG. 2*a* is a side view of a freighter.
Figure 2B:
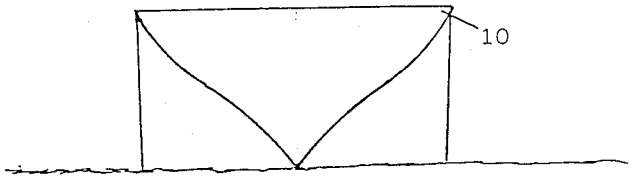
FIG. 2*b* is a view on the cross section of the freighter according to FIG. 2*a;*

In a situation with a vertical lift-bridge being present for instance near to one of the doors 7, which bridge has an open position perpendicular to the plan of the drawing and is located near to the side of the embankment, an exceptionally dangerous situation can arise especially when the ship has a form as represented in FIGS. 2*a* and 2*b*. The ship shown in FIG. 2*a* in side-elevation is a car-carrier. Ships of this kind are characterized by a large flat hull sidepart 9 over practically the entire length of the ship; this length can be for instance 150 meters and the height of the ship above the water level can amount to 15 meters. It is obvious that already with low windspeeds very large forces are exerted by the wind on the ship so that the ship easily can loose its course.

FIG. 2*b* shows a cross-section through the bow of the ship. As set out hereinabove the overhanging part 10, unless special precautions are taken, can easily damage structures on the embankment such as open vertical lift-bridges, when the ship loses its course.

Figure 4:
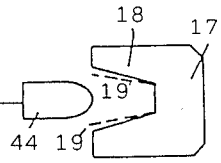
FIG. 4 shows schematically a plan view of the shunter according to the invention.

FIG. 4 schematically shows a shunter according to the invention, which can be used to solve the above described problems. The shunter 17 has a U-like stern 18, with an opening in which the bow of the ship, which is to be directed into the lock, fits. In the U-like stern 18 suction heads 19 are provided of which the position can be so adjusted that the heads touch the bow of the ship. The suction head 19 has a number of elements which have the form of a box open to one side. These elements can be connected to a vacuum conduit and on the side of the bow of the ship they are provided with an elastic sealing member assuring a practically airtight seal against the hull of the ship.

Figure 3:
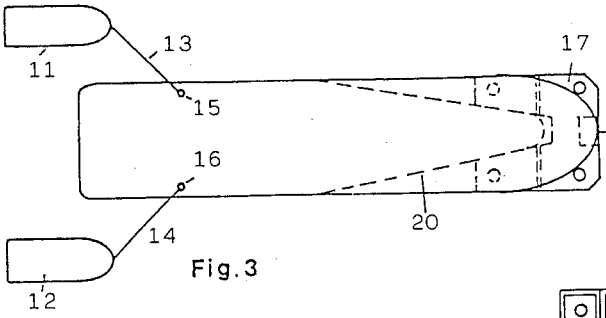
FIG. 3 shows a plan view of a freighter to which a shunter according to the invention is coupled.

FIG. 3 shows a method according to the invention. The ship is guided when entering the lock, at the stern by the shunter 17, which as is clear from FIG. 5*c* also can exert forces in a lateral direction of the ship. If desired a propulsion can moreover be obtained by a preceding vessel, indicated with the reference no. 44. The guidance of the stern is carried out in the usual manner with two tugs 11 and 12 which are connected by hawsers 13 and 14 respectively to bollards 15 and 16 on the ship. Reference no. 20 is the waterline of the ship and as may be seen from FIG. 3 the shunter 17 is partly located under the ship to be entered.

Figure 5B:
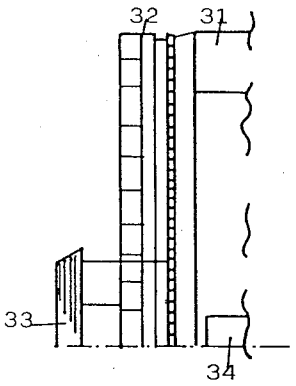
FIG. 5*b* shows partly a front view of the part of the shunter according to the invention above the water level.
Figure 5A:
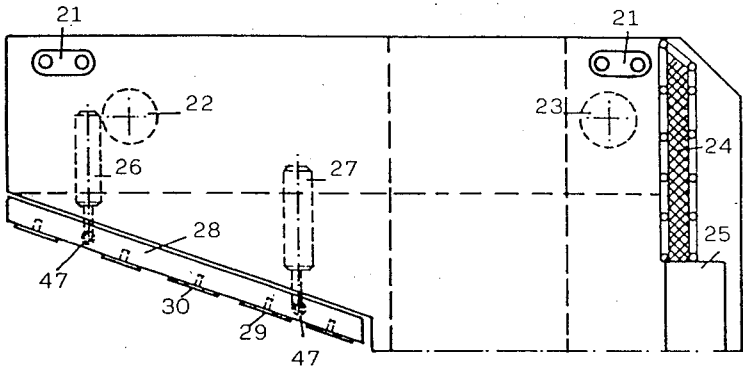
FIG. 5*a* shows a part plan view of the shunter according to the invention.

FIG. 5*a* shows a plan view of a part of a shunter according to the invention wherein for clearness sake, only one of the symmetrical halves of the shunter are represented. Reference no. 21 indicates bollards for the connection of hawsers. Reference no. 22 indicates schematically the connection for a schottel-propulsion mechanism, which is preferably used in a shunter according to the invention. The same applies to reference no. 23. The schottel-propulsion devices are shown in more detail in FIG. 5*c* and indicated with reference no. 38 and 40.

Reference no. 24 denotes a grating for walking and reference no. 25 indicates the bridge of the shunter. In the U-like stern of the shunter a pair of suction heads is located of which only one is shown and indicated with the no. 28. This suction plate 28 can be adjusted with the use of hydraulic adjustment cylinders 26 and 27 enabling an adjustment to the bow angle of the ship to be maneuvered. The adjustment cylinders 26 and 27 are connected to the suction head 28 by means of universal joints 47. If desired more adjustment cylinders 26 and 27 can be used and the suction head 28 can be subdivided into more sections each having one or more suction elements; these sections can if desired be adjusted separately with adjustment cylinders. The vacuum-element 29 is shown in more detail in FIG. 6*b*. The vacuum-elements 29 have a connection 30 for a vacuum conduit which is connected to a vacuum source.

FIG. 5*b* gives a front view of a part of the shunter according to FIG. 5*a*. In this figure the reference no. 33 indicates the bridge of the ship, reference no. 32 a railing, reference no. 31 the hull and reference 34 the anchor hawse.

Figure 5C:
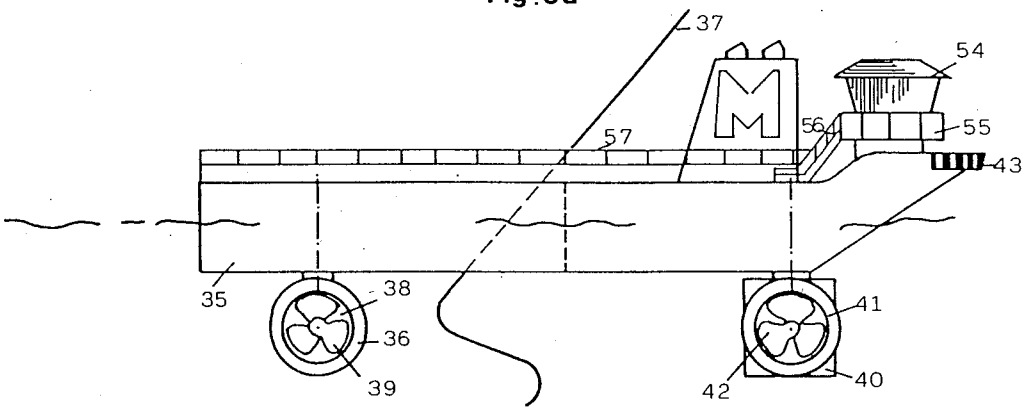
FIG. 5*c* shows a side view of the shunter according to the invention.

FIG. 5*c* shows a side view of the shunter according to FIG. 5*a*. The hull of the shunter has been indicated with the reference no. 35. 57 is a railing which runs around the bridge 54 and the grating 24. Reference no. 37 indicates the bow of the ship to be maneuvered. The shunter has been provided with a pair of front schottel-propulsion devices of which one bears the reference no. 40. These front schottel-propulsion devices 40 can be rotatable thereby giving a propulsion in any desired direction. Each of the propulsion devices 40 can give a force of propulsion of 15 tons. The schottel-propulsion device 40 is provided with a propellor 42 which can be rotatable within the tube 41.

Figure 6B:
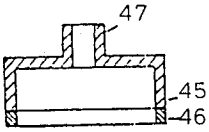
FIG. 6*b* shows an element of a suction head according to the invention.
Figure 6A:
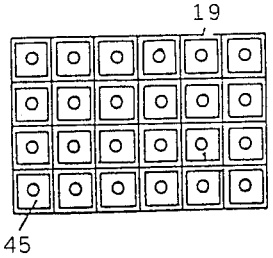
FIG. 6*a* shows a suction head which is used according to the invention.

The shunter according to the invention is also provided with two rear schottel-propulsion devices 38 each having a propellor 39 and a tube 36. These rear propulsions can deliver for instance a propulsion force of 15 tons each. As a matter of fact the number of schottel-propulsion devices is not limited to four but circumstances to be satisfied can lead to the use of other numbers; also the propulsion force can be adjusted. If necessary the rear schottel-propulsion devices could also be rotatable. Reference no. 43 indicates a rubber fender. FIG. 6*a* shows schematically an example for a suction head which can be used according to the invention. The suction head according to FIG. 6*a* has been given only by way of example. The arrangement of the vacuum elements 45 is an arbitrarily chosen arrangement. The elements 45 can be interconnected to sections in rows or columns; such sections can for instance also consist of blocks of a arbitrary number of vacuum elements 45. The sections can be connected to adjustment cylinders with the use of universal joints such as the universal joint 47 in FIG. 5*a;* this creates the possibility to adjust the surface of the suction head 19 to any arbitrarely curved surface. It is not necessary for the vacuum elements 45, as shown in FIG. 6*a,* to be adjoining; they can be arranged with a certain distance between them. FIG. 6*b* shows on a large scale a suction head element. This element comprises a box 45 open to one side on which an elastic seal 46 is provided. Part 47 is for the connection with a vacuum lead to the vacuum source.

It will be apparent to those skilled in the art that the invention is not limited to the embodiments as shown and that many other embodiments are possible.

What is claimed is:

1. A shunter for use in maneuvering a ship particularly in entering and passing relatively narrow passageways, such as a lock of a canal, comprising:

a shunter having a deck and being capable of exerting substantial propulsion forces so as to maneuver a ship, and having a stern of substantially U-shape to fit about the bow or stern of said ship with a pair of legs having on the inner sides thereof at least one suction head; said suction heads being mounted to said pair of legs on said inner sides substantially below said deck adjacent the water line and being movable and adjustable by hydraulic cylinders so that said suction heads are adapted to be brought into contact with said bow or stern of said ship; and vacuum means connected to said suction heads; and said suction heads being adapted to be rigidly affixed, although only temporarily, to said ship by means of a vacuum in a location substantially near to the horizontal plane of the propulsion force of said shunter craft so as to be near where directional forces of said shunter craft are exerted; and said shunter craft and said ship in effect forming a single unit when affixed together, and said ship being adapted to be maneuvered into a desired position by propulsion means provided on said shunter craft exerting forces particularly in a direction perpendicular to the longitudinal axis of said ship.

2. The shunter, according to claim 1, wherein said propulsion means are devices rotatably disposed as front and rear schoettel-propulsion devices, and with the propulsion force generated by said devices all being of the adjustable type.

3. The shunter, according to claim 1 wherein each of said suction heads comprise a number of sections; and each said section having at least one vacuum element connected to said vacuum means, and said sections of each said suction head being adapted to be independently adjustable by separate adjustable cylinders.

4. The shunter, according to claim 3, wherein each said section is provided with elastic sealing means for forming a generally air tight seal against the hull of said ship.

5. The shunter, according to claim 1, wherein said shunter craft includes a floatable hull and said means for exerting forces comprises at least one schottel-propulsion device on each leg formed by said U-shaped stern.

6. A method for maneuvering a ship particularly in entering and passing through relatively narrow passageways, such as a lock of a canal, comprising:

positioning against said ship a shunter craft having a deck and having a stern of substantially U-shaped to fit about the bow or the stern of the ship with a pair of legs having on the inner side thereof at least one suction head on each of said legs;

said suction heads being mounted to said pair of legs on said inner sides substantially below deck adjacent the water line and being movable and adjustable by hydraulic cylinders so that said suction heads are adapted to be brought into contact with said bow or stern of said ship;

rigidly affixing, although only temporarily, said suction heads to said ship substantially near to the horizontal plane of the propulsion forces of said shunter craft; and pulling a vacuum on said suction heads so as to cause said rigid, but yet temporary, connection between said shunter craft and said ship;

whereby said ship can be maneuvered into a desired position by propulsion means provided on said shunter craft which are capable of exerting forces, particularly in a direction perpendicular to the longitudinal axis of said ship.

* * * * *